US006135703A

United States Patent [19]

Neri

[11] Patent Number: 6,135,703

[45] Date of Patent: Oct. 24, 2000

[54] DEVICE AND A METHOD FOR ORIENTING SHEETS OR GROUPS OF SHEETS, IN PARTICULAR BANKNOTES

[75] Inventor: Armando Neri, Bologna, Italy

[73] Assignee: G.D S.p.A., Bologna, Italy

[21] Appl. No.: 09/093,901

[22] Filed: Jun. 9, 1998

[30] Foreign Application Priority Data

Jun. 9, 1997 [IT] Italy ..... BO97A0347

[51] Int. Cl.[7] ..... B65G 57/00

[52] U.S. Cl. ..... 414/791.2; 414/788.3; 209/534

[58] Field of Search ..... 414/791.2, 792.4, 414/788.6; 209/754, 534

[56] References Cited

U.S. PATENT DOCUMENTS

| | | | |
|---|---|---|---|
| 1,994,636 | 3/1935 | Donnellan | 414/791.2 |
| 4,015,842 | 4/1977 | Perry | 414/791.2 |
| 4,483,124 | 11/1984 | Ohba et al. | 209/534 |
| 4,655,663 | 4/1987 | Rosati | 414/788.3 |
| 4,886,265 | 12/1989 | Wetter | 414/791.2 |
| 5,195,731 | 3/1993 | Kobler et al. | 414/788.3 |
| 5,353,576 | 10/1994 | Palamides et al. | 414/791.2 |
| 5,522,511 | 6/1996 | Sakoguchi et al. | 209/534 |

FOREIGN PATENT DOCUMENTS

| | | |
|---|---|---|
| 648 263 A5 | 3/1985 | Switzerland . |
| 2 262 729 | 6/1993 | United Kingdom . |

*Primary Examiner*—Gregory A. Morse
*Attorney, Agent, or Firm*—Pillsbury Madison & Sutro LLP

[57] ABSTRACT

Paper sheets are oriented singly or in bundles using a device applicable to a machine by which the sheets, typically banknotes or previously assembled bundles of banknotes, are ordered into stacks. The machine comprises a series of stacking stations, supplied with the single or bundled banknotes by way of corresponding feed ducts, each equipped with a relative orienting device which in turn comprises receiving and accumulating mechanisms by which the sheets emerging from the duct are gathered into an ordered stack, and orienting elements, interposable between the duct and the receiving and accumulating mechanisms, by which the sheets are taken up and rotated through a predetermined angle.

17 Claims, 3 Drawing Sheets

DEVICE AND A METHOD FOR ORIENTING SHEETS OR GROUPS OF SHEETS, IN PARTICULAR BANKNOTES

BACKGROUND OF THE INVENTION

The present invention relates to a device for orienting sheets or groups of sheets, in particular banknotes.

The present invention is employable to advantage in machines by which banknotes are ordered and wrapped in bundles, the field to which direct reference is made in the following specification albeit without implying any limitation in general scope.

The prior art embraces machines designed to control the quality and integrity of banknotes, consisting typically of a plurality of stacking modules each equipped with a respective formation channel. The stacking modules are filled at their infeed ends with a succession of single notes, which may be of any given type, whereupon these are examined, for example by optical means, and any defective items eliminated; thereafter, the notes are divided up according to denomination and/or type and directed toward respective independent outlets afforded by the selfsame stacking modules of the machine.

In this way, groups or stacks of single banknotes are formed at each of the outlets.

Once a predetermined number of banknotes per group has accumulated, the group or stack is picked up and transferred to a bundling machine by which it is bound with at least one wrapping band.

Alternatively, the machines in question can be supplied at the infeed end of each stacking module with a succession of bundle, i.e. sheets already checked and bound with respective wrapping bands, in such a way that the banknotes collecting at the outlets of the single formation channels consist not of stacks of discrete notes, but of stacks of bundled notes that are then picked up and transferred to other operating stations of the machine.

The operation of stacking banknotes to prepare them for subsequent bundling is adversely affected by the difficulty of ensuring a certain regularity in height of the stacks.

In effect, it will often be the case that lateral portions of the single banknotes present impressed stamps or watermarks tending to modify the surface of the paper money, inasmuch as these same lateral portions, originally smooth, assume a thickness greater than that of the note overall. Thus, if all or at least the majority of the banknotes happen to be oriented in the same manner, the height of the accumulating stacks will not be constant, that is to say the stack becomes higher on one side than on the other, and thus unstable to the point that it is impossible for the notes to be stacked neatly.

The same problem is experienced when banknotes are stacked already in bundles, because of the wrapping band placed around each bundle.

The object of the invention is to set forth a device, suitable for use in a machine for stacking banknotes singly or in bundles, that will allow orienting of the single notes or bundles during the formation of the respective stacks in such a way as to obtain stacks of substantially constant height.

SUMMARY OF THE INVENTION

The stated object is realized in a device for orienting sheets or groups of sheets, in particular banknotes or bundles of banknotes emerging from respective checking stations of a machine by which the single or bundled banknotes are assembled into ordered stacks.

Such a machine comprises a plurality of stacking stations equipped with respective feed ducts along which the single or bundled banknotes are directed, receiving and accumulating means by which the sheets emerging from each duct are taken up and gathered into an ordered stack; preferably, the device comprises orienting means associated with each of the stacking stations, interposable between the feed duct and the receiving and accumulating means, by which the sheets are taken up and rotated through a predetermined angle.

The present invention relates also to a method of orienting sheets or groups of sheets, in particular banknotes.

More exactly, the invention relates to a method of orienting sheets or groups of sheets, in particular banknotes or bundles of banknotes emerging from respective checking stations of a machine for the assembly of banknotes or bundles of banknotes into ordered stacks, comprising a plurality of stacking stations provided with respective feed ducts along which the single or bundled banknotes are directed; the steps of the method disclosed include conveying the single or bundled banknotes along the duct toward receiving and accumulating means by which the emerging sheets are taken up and gathered into an ordered stack, and selectively rotating the sheets through a predetermined angle before their accumulation into an ordered stack.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
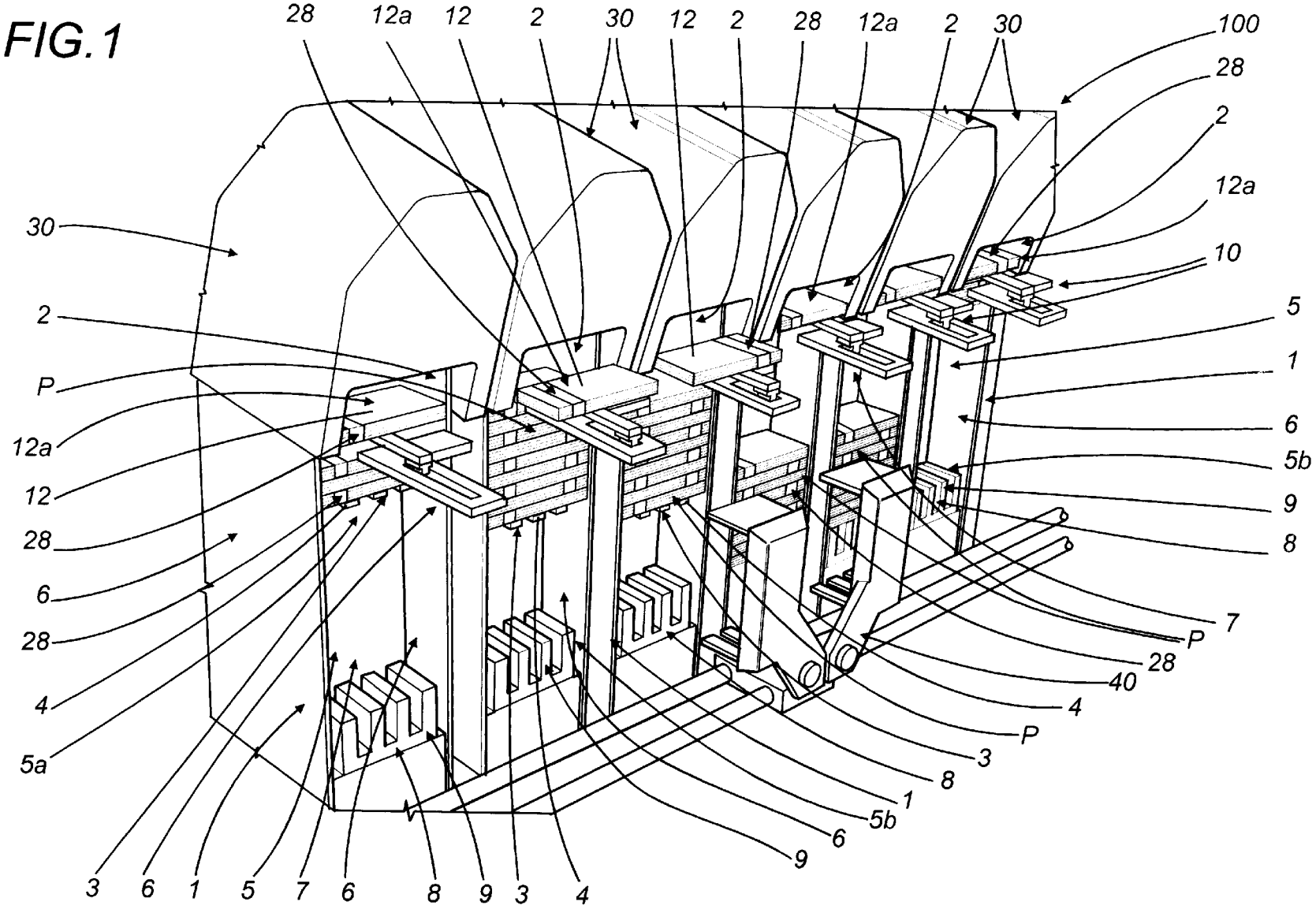
FIG. 1 illustrates a machine for the assembly of single banknotes or bundles of banknotes into stacks, seen schematically in perspective and with certain parts omitted, which is equipped with a plurality of stacking modules, and associated with each of the modules, a device according to the present invention.
Figure 4:
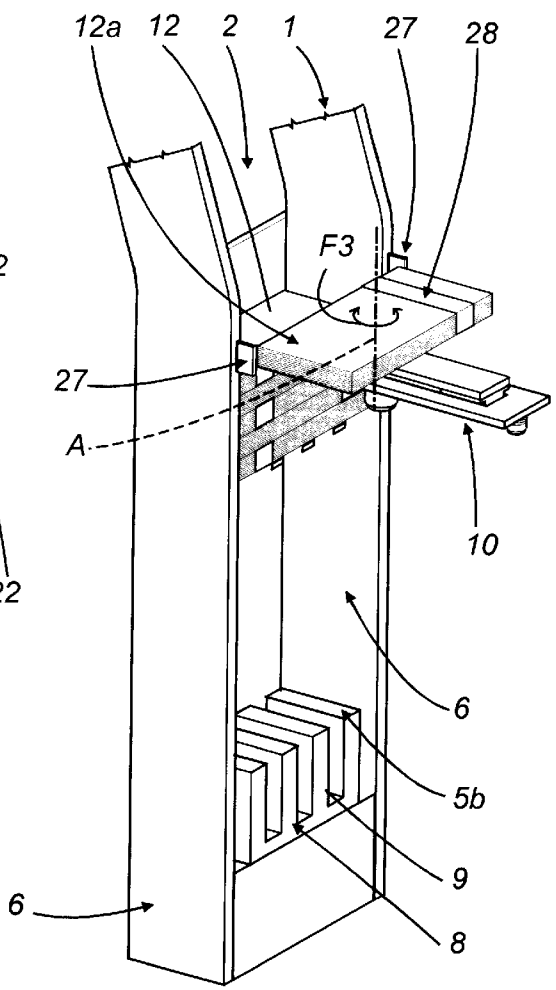
FIGS. 2, 3, 4, 5 and 6 illustrate single stacking modules, seen schematically in perspective and with certain parts omitted, and associated with each stacking module, a device according to the present invention shown in a succession of operating steps by which the bundle of banknotes is oriented.

With reference to the drawings, FIG. 1 illustrates a machine, denoted 100 in its entirety, by which banknotes 12 or bundles 12*a* of banknotes are formed into stacks P at a plurality of stacking modules or stations 1 with which the machine is equipped.

Each stacking station 1 comprises a feed duct 2 along which banknotes 12 are conveyed either singly or in bundles 12*a*, already checked and selected and, in the case of a bundle, bound with at least one wrapping band 28. The single banknotes 12 or bundles 12*a* are directed into the feed duct 2 from a respective checking station 30 indicated only in part and schematically in FIG. 1, being conventional in embodiment.

It will be noted that the present specification is accompanied by drawings showing only bundles 12*a* of banknotes 12, given that the application of the invention to single sheets requires no further explanation or detailed illustration.

The banknotes 12 or bundles 12*a* emerging from the feed duct 2 are caused to drop by force of gravity onto first support means consisting of a companion element 3 with fingers 4 affording a first bearing surface for the banknotes 12 or bundles 12*a*.

The companion element 3 is able to reciprocate along a stacking channel 5 having a substantially vertical axis. The channel 5 is open to the front and equipped with side walls 6 and at least one rear wall 7 between which the single banknotes 12 or bundles 12*a* are contained. More exactly, the companion element 3 is capable of movement between a first receiving position, coinciding with the upper part 5*a* of the channel 5, in which the single banknotes 12 or bundles 12*a* emerging from the feed duct 2 are deposited in succession one on top of another on the fingers 4 of the companion element 3 to the point of forming an ordered stack P, and a second release position coinciding with the lower part 5*b* of the channel 5, in which the stack P formed on the companion element 3 is transferred to support means consisting of a fixed element 8 with upwardly directed projectors 9 insertable between the fingers 4 of the companion element 3 in such a way that a stack P can be deposited on the support element 8 as the fingers descend.

The lower part 5*b* of the stacking channel 5 affords an outlet by way of which the stacks P are removed from the station 1. To this end, as shown in FIG. 1, the machine 100 also comprises gripper means 40 by which the stacks P of banknotes 12 or bundles 12*a* occupying the outlet of each channel 5 are picked up and transferred to other operating stations of the machine not illustrated in the drawings.

According to the present invention, the runout of each feed duct 2 is equipped with an orienting device 10 comprising means by which the single banknotes 12 or bundles 12*a* of banknotes emerging from the duct 2 can be reoriented as appropriate.

As indicated in FIGS. 2 to 8, the aforementioned means by which to reorient the banknotes 12, or bundles 12*a*, comprise a substantially horizontal table 11 rotatable about a substantially vertical axis A extending substantially parallel to the longitudinal axis of the channel 5.

Figure 3:
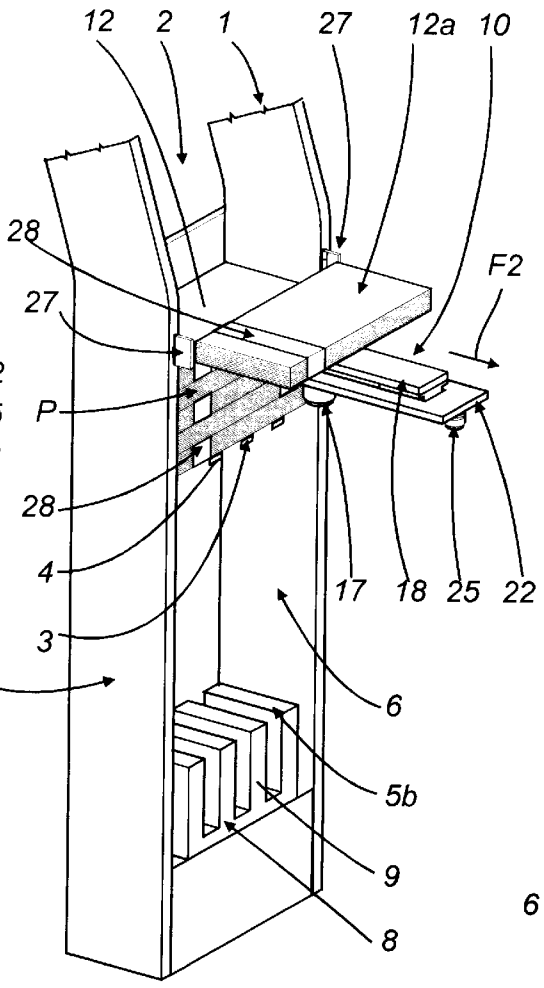
Figure 6:
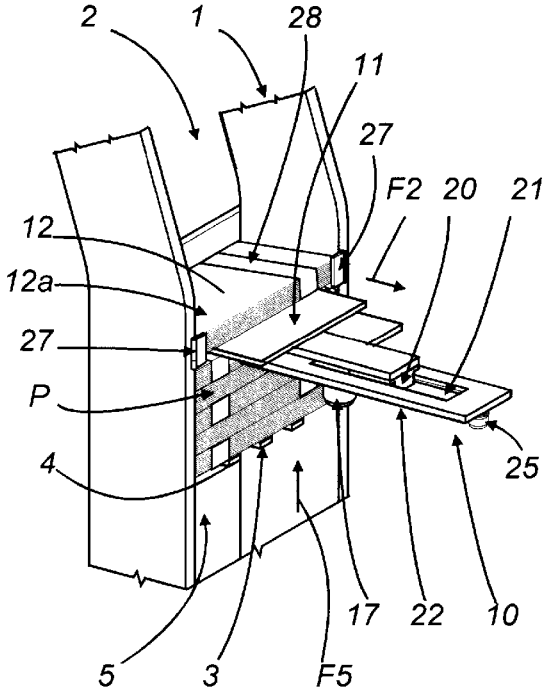

The table 11 is capable of movement cyclically in relation to the stacking channel 5 between a first operating position, within the channel 5 and below the runout from the duct 2 as illustrated in 2, and a second operating position outside the channel 5 as illustrated in FIG. 3. Also forming part of the device 10 are restraint means 27 associated with the channel 5 in such a way as to interact with the banknotes 12 or bundles 12*a*; more exactly, such means are located in alignment with the operating position of the table 11, supported by the side walls 6 of the channel 5 and rendered capable of movement through the agency of drive means (not illustrated) between an open position, and a closed position in which the leading edge of a bundle 12*a* will be intercepted. The function of the restraint means 27 when in the closed position, indicated in FIG. 6, is to immobilize the bundle 12*a* during the movement of the table 11 from the first operating position to the second operating position outside the channel 5, in such a way that the bundle 12*a* resting thereon can drop neatly onto the top of the accumulating stack P. Accordingly, the restraint means 27 will assume the closed position only after the bundle 12*a* currently occupying the table 11 has been correctly oriented by the device 10, and the table 11 is then distanced from the first operating position, regained after the step of orienting the bundle 12*a*.

Figure 7:
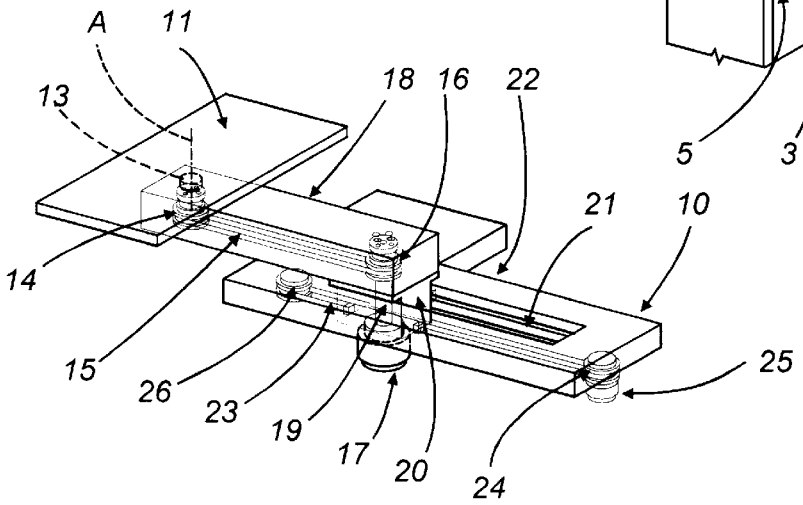
FIG. 7 illustrates one embodiment of the device according to the present invention, viewed schematically and in perspective.
Figure 8:
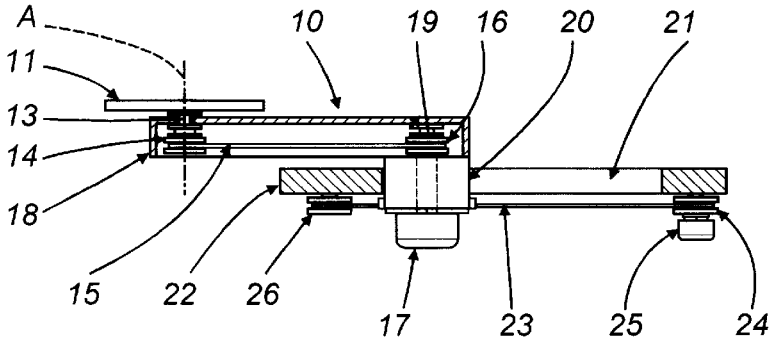
FIG. 8 illustrates the device of FIG. 7 in a side elevation, with certain parts omitted.

Viewing the embodiment of the orienting device 10 shown in FIGS. 7 and 8, the table 11 is furnished on the underside with a pivot 13, of which the axis coincides substantially with the aforementioned axis A of rotation and passes substantially through the centre of the table 11. The pivot 13 carries a keyed driven wheel or pulley 14 forming part of a flexible transmission 15, such as a chain or timing belt drive, of which the driving wheel or pulley 16 is set in rotation by a motor 17.

The belt drive 15, with the relative driving and driven pulleys 16 and 14, is accommodated within a housing and support element 18. The pivot 13 of the driven pulley 14 is supported rotatably by a first end of the element 18, while the opposite end of the element 18 supports a shaft 19 of the motor 17 to which the driving pulley 16 is keyed.

The shaft 19 passes through a slide denoted 20, accommodated within a slot 21 provided in a substantially horizontal bracket 22 extending perpendicular to the channel 5. The bracket 22 is secured to one of the side walls 6 of the channel 5 (FIGS. 1 to 6).

The slide 20 is made to travel along the slot 21 by actuator means comprising an open loop flexible drive component 23, for example a chain or a timing belt secured by its ends to the slide 20, which is passed around a respective driving pulley 24 set in rotation by a relative motor 25, and a respective driven pulley 26.

The pulleys 24 and 26 are supported rotatably by the bottom face of the guide 22.

Figure 2:
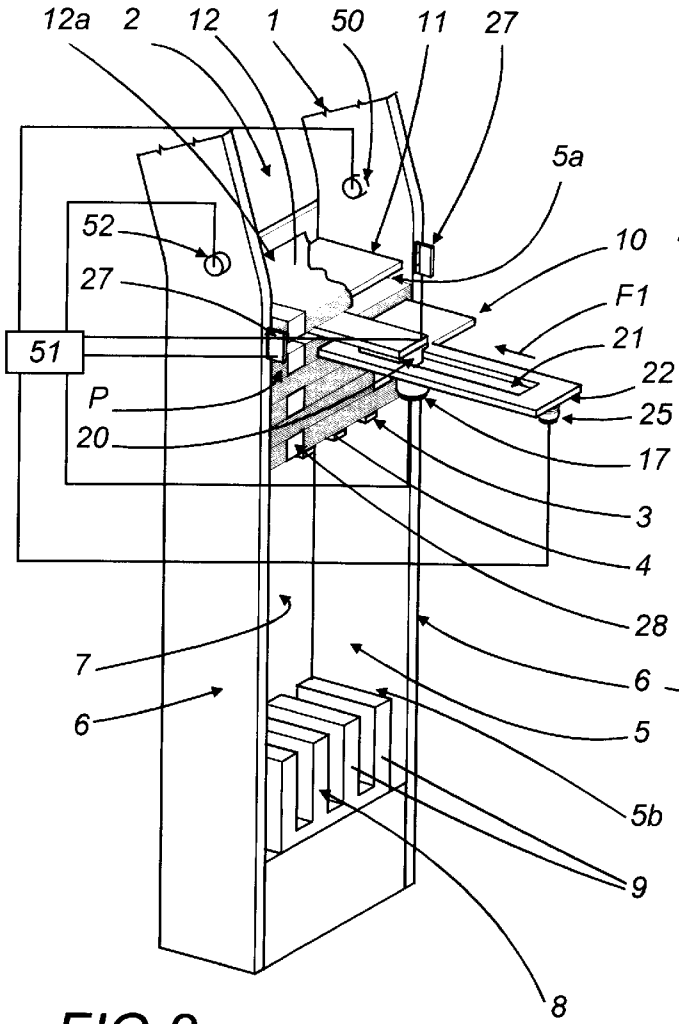
Figure 5:
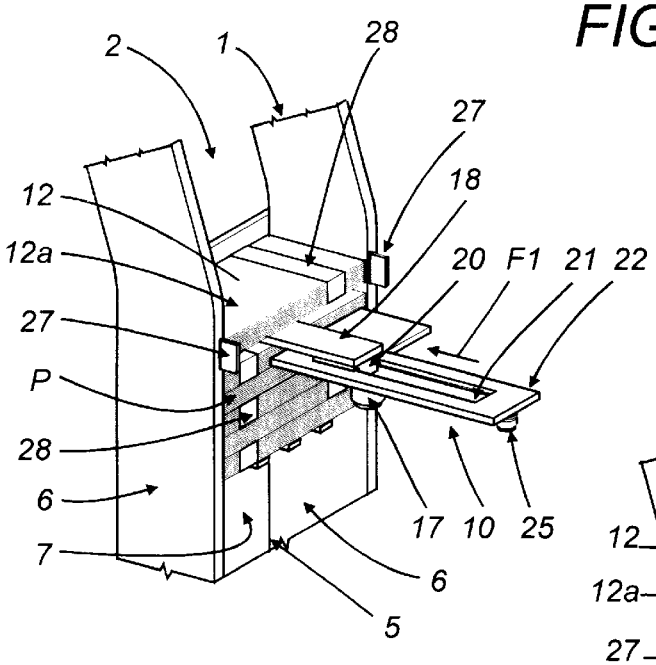

In the event that the banknotes 12 or bundles 12*a* should reach the device 10 all similarly oriented, as indicated in FIG. 2, sensing means 50 located along the feed duct 2 are designed to verify each banknote 12 or bundle 12*a* emerging from the feed duct 2 and, through the agency of a monitoring and control unit 51, to activate the device 10 on the arrival of every second banknote 12 or bundle of notes 12*a*.

The banknotes 12 or bundles 12*a* might also reach the device 10 randomly oriented, in which case the sensing means 50 located along the feed duct 2 will be associated with detection means 52 (see FIG. 2) designed to verify the arrival of each banknote 12 or bundle 12*a* and establish its orientation, then by way of the same monitoring and control unit 51 to activate the device 10 in such a way that each will be rotated through 180° in relation to those adjacent in the stack P.

Assuming, with the machine in operation, that the banknotes 12 or bundles 12*a* of notes reach the device 10 similarly oriented, the sensing means 50 will register the presence of each note 12 or each bundle 12*a* passing along the feed duct 2, and pilot the operation of the device 10 intermittently in such a manner as to rotate each alternate note 12 or bundle 12*a* through 180°. Whenever the device 10 is activated, the flexible drive 23 displaces the slide 20 along the slot 21 toward the channel 5 in the direction denoted F1 (see FIG. 2), so that the table 11 is brought to the first operating position in the channel 5. In this position, the notes 12 or bundles 12*a* advancing along the feed duct 2 are intercepted by and thus brought to rest on the table 11.

Thereafter, the slide 20 is caused by the flexible drive 23 to traverse in the opposite direction F2 (see FIG. 3) and the table 11 is brought into the second operating position located outside the channel 5. Once the table 11 has reached the second operating position, the slide 20 ceases its movement and the motor 27 will be activated to operate the relative drive 15, with the result that the table 11 is rotated through 180° about the vertical axis A in the direction denoted F3 (see FIG. 4), and the orientation of the note 12 or the bundle

12*a* thus reversed in relation to that of the note 12 or the bundle 21*a* currently at the top of the stack P. The rotation of the table 11 having been completed, the slide 20 moves back toward the channel 5 in the initial direction F1 (see FIG. 5) so as to return the table 11 to the first operating position internally of the channel 5 and thereafter begins to move away in the opposite direction F2 (see FIG. 6), taking the table 11 toward the second operating position.

Prior to this step, the restraint means 27 are activated and brought into their closed position to intercept the leading edge of the bundle 12*a*, with the result that the banknote 12 or the bundle 12*a* is prevented from translating together with the table 11 and caused instead to slip onto the top of the stack P forming on the companion element 3.

To ensure additionally that a single banknote 12 or bundle 12*a* cannot flip undesirably when dropping onto the accumulating stack P as the table 11 is distanced in the direction denoted F2 (see FIG. 6) toward the second operating position, the companion element 3 preferably will be elevated within the channel 5 (direction F5), in such a manner as to bring the top of the accumulating stack P as near as possible to the single note 12 or bundle 12*a* and thus minimize the drop from the table 11 onto the top of the stack P.

The note 12 or bundle 12*a* having been transferred, the companion element 3 is lowered to eliminate any risk that the accumulating stack P could interfere thereafter with the movement of the table 11 during its return to the first position internally of the channel 5.

In the event that the sheets are made to advance along the feed duct 2 randomly oriented, whether single banknotes 12 or bundles 12*a*, the monitoring and control unit 51 will pilot the device 10 to operate only when the orientation of an approaching note 12 or bundle 12*a* is identical to that of the preceding note 12 or bundle 12*a*.

What is claimed:

1. A sheet orienting device, comprising:

at least one checking station from which sheets emerge to be stacked;

at least one stacking station including a feed duct along which the sheets are directed;

a receiver associated with each feed duct, adapted to receive and accumulate the sheets emerging therefrom;

an orienter associated with each stacking station, constructed and arranged to be capable of movement between a first operating position, interposed between the feed duct and the receiver of the associated stacking station, and a second operating position, distanced from the feed duct and the receiver of the associated stacking station, the orienter rotating sheets through a predetermined angle while at the second operating position; and an actuator, constructed and arranged to move the orienter from the first operating position to the second operating position.

2. A device as in claim 1, wherein the predetermined angle is substantially equivalent to 180°.

3. A device as in claim 1, wherein the orienter is rotatable about a substantially vertical axis.

4. A device as in claim 1, wherein the orienter comprises a table constructed and arranged to support the sheets and disposed substantially normal to the vertical axis.

5. A device as in claim 4, wherein the dimensions of the table, viewed in plan, are less than those of the sheets.

6. A device as in claim 4, wherein the orienter comprises a driver by which the table is caused to rotate about the vertical axis.

7. A device as in claim 6, wherein the driver comprises a flexible transmission component driven by a motor, which is constructed and arranged to rotate a pivot associated permanently with the underside of the table.

8. A device as n claim 1, further comprising a movable restraint constructed and arranged to disallow movement of the sheets, after being rotated through the predetermined angle by the table, when the selfsame table is in motion from the first operating position to the second operating position.

9. A device as in claim 1, wherein the actuator comprises a slide capable of movement along a guide.

10. A device as in claim 9, wherein the orienter is associated with and translatable with the slide.

11. A device as in claim 1, wherein the orienter further comprises:

a sensor, constructed and arranged to determine an orientation of a stack of sheets in the receiver; and a controller, causing the orienter to be actuated to rotate the stack of sheets if an immediately preceding stack of sheets had a same orientation as the stack of sheets in the receiver.

12. A method of orienting sheets, comprising:

feeding the sheets along a feed duct toward a receiver;

accepting the sheets onto a table, the table being movable between a first operating position, interposed between the feed duct and the receiver, and a second operating position, distanced from the feed duct and the receiver;

rotating the sheets on top of the table, while at the second operating position, through a predetermined angle; and depositing the sheets into an ordered stack.

13. A method as in claim 12, wherein the predetermined angle is substantially 180°.

14. A method as in claim 12, wherein the sheets are rotated in alternating sequence through the predetermined angle before being accumulated into an ordered stack.

15. A method as in claim 13, wherein the sheets are first rotated through the predetermined angle and thereafter transferred from the table onto a stack.

16. A method as in claim 15, wherein transferring the sheets from the table to the top of the stack is preceded by elevating the stack in such a way as to minimize the vertical distance covered by the sheets during their transfer from the table to the stack.

17. A method as in claim 11, further comprising:

sensing an orientation of a stack of sheets in the receiver;

actuating the orienter to rotate the stack of sheets if an immediately preceding stack of sheets had a same orientation as the stack of sheets in the receiver.

* * * * *